US009995434B2

(12) United States Patent
Sassi et al.

(10) Patent No.: US 9,995,434 B2
(45) Date of Patent: Jun. 12, 2018

(54) SEALED AND INSULATING TANK DISPOSED IN A FLOATING DOUBLE HULL

(71) Applicant: GAZTRANSPORT ET TECHNIGAZ, Saint Remy les Chevreuse (FR)

(72) Inventors: Mohamed Sassi, Meudon-la-Foret (FR); Cedric Morel, Lieusaint (FR); Guillaume Gelin, Palaiseau (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 0 days. days.

(21) Appl. No.: 15/321,203

(22) PCT Filed: Jun. 29, 2015

(86) PCT No.: PCT/EP2015/064705
§ 371 (c)(1),
(2) Date: Dec. 22, 2016

(87) PCT Pub. No.: WO2016/001142
PCT Pub. Date: Jan. 7, 2016

(65) Prior Publication Data

US 2017/0152993 A1 Jun. 1, 2017

(30) Foreign Application Priority Data

Jul. 4, 2014 (FR) ..... 14 56488

(51) Int. Cl.
*B63B 25/08* (2006.01)
*F17C 3/02* (2006.01)
(Continued)

(52) U.S. Cl.
CPC ..... *F17C 3/027* (2013.01); *B63B 25/16* (2013.01); *B63B 27/25* (2013.01); *F17C 6/00* (2013.01);
(Continued)

(58) Field of Classification Search
CPC ..... F17C 3/027; B63B 25/16; B63B 27/25
See application file for complete search history.

(56) References Cited

U.S. PATENT DOCUMENTS 3,379,027 A * 4/1968 Mowell ..... F16L 3/18 114/74 A
2014/0124086 A1* 5/2014 Jean ..... F17C 3/027 141/1

FOREIGN PATENT DOCUMENTS

DE 9313562 U1 11/1993
FR 1318891 A 2/1963
KR 20100092748 A 8/2010

OTHER PUBLICATIONS

International Search Report with regard to PCT/EP2015/064705 dated Aug. 3, 2015.

(Continued)

*Primary Examiner* — Stephen P Avila
(74) *Attorney, Agent, or Firm* — BCF LLP

(57) ABSTRACT

An internal bottom wall of the double hull bears a sump structure comprising a rigid container arranged through the thickness of the bottom wall of the tank and intended to accommodate a suction member of a pump. The rigid container comprises a bottom wall situated at a level further toward the outside than the secondary sealing membrane of the bottom wall of the tank. The sump structure comprises a primary connecting plate surrounding the container, the primary connecting plate having a connecting surface extending parallel to the primary sealing membrane of the bottom wall of the tank, the primary sealing membrane of the bottom wall of the tank being attached in a sealed manner to the connecting surface all around the sump structure.

23 Claims, 6 Drawing Sheets

(51) Int. Cl.

| | |
|---|---|
| ***F17C 6/00*** | (2006.01) |
| ***F17C 9/00*** | (2006.01) |
| ***F17C 13/00*** | (2006.01) |
| ***B63B 25/16*** | (2006.01) |
| ***B63B 27/25*** | (2006.01) |

(52) U.S. Cl.

CPC ..... *F17C 9/00* (2013.01); *F17C 13/004* (2013.01); *B63B 2734/00* (2013.01); *F17C 2203/035* (2013.01); *F17C 2203/0325* (2013.01); *F17C 2203/0333* (2013.01); *F17C 2203/0358* (2013.01); *F17C 2203/0631* (2013.01); *F17C 2203/0682* (2013.01); *F17C 2205/0335* (2013.01); *F17C 2221/033* (2013.01); *F17C 2223/033* (2013.01); *F17C 2227/0135* (2013.01); *F17C 2227/0178* (2013.01); *F17C 2227/04* (2013.01); *F17C 2260/01* (2013.01); *F17C 2260/02* (2013.01); *F17C 2270/0107* (2013.01)

(56) References Cited

OTHER PUBLICATIONS

English Translation of Description and Claims of DE9313562 retrieved on Espacenet on Dec. 16, 2016.
English Translation of Description and Claims of FR1318891 retrieved on Espacenet on Dec. 16, 2016.
English Abstract of KR20100092748 retrieved on Espacenet on Dec. 16, 2016.

* cited by examiner

SEALED AND INSULATING TANK DISPOSED IN A FLOATING DOUBLE HULL

CROSS-REFERENCE

The present application is a National Phase Entry of International Patent Application No. PCT/EP2015/064705 filed on Jun. 29, 2015 and claims priority of the French Patent Application No. 1456488 filed on Jul. 4, 2014, the entire contents of which are incorporated herein by reference.

FIELD OF THE INVENTION

The invention relates to the field of tanks with sealed and insulating membranes arranged in floating structures, notably for the storage and/or transportation of a cold product, notably a liquefied gas, for example liquefied natural gas (LNG) which contains a high methane content and has a liquid state at around −162° C. at atmospheric pressure.

BACKGROUND

In the art of membrane-type tanks, the internal surfaces of a bearing structure such as the internal hull of a double-hulled ship are lined with a multilayered structure comprising two thin sealing membranes alternating with two layers of thermal insulation which serve both to limit heat flux through the tank wall and to provide structure support for the sealing membranes.

In order to maximize operational yield of such a tank it is desirable to optimize the usable volume of cargo that can be loaded into the tank and unloaded from the tank. However, the use of an unloading pump that draws the liquid toward the top of the tank means that a certain head of liquid needs to be left in the bottom of the tank otherwise the suction member of the pump will come into communication with the gaseous phase which will cause the pump to become air-bound and/or damaged. Given the way in which the cargo is sloshed around by the swell, the head of liquid required can be minimized only with difficulty.

Publication FR-A-2832783 envisions the creation of a sump in the cryogenic insulation of the tank as being a solution that is expensive and rather ineffectual.

Publication KR-10-2010-0092748 discloses a sump obtained by creating a concave stepped portion in the bottom wall of a membrane-type tank. This stepped portion nevertheless still has difficulties in realizing it given the need to divert the entire multilayer structure of the tank wall into the concave stepped portion.

FR1318891 describes a self-supporting metal tank for liquefied gas which is positioned in a ship with the interposition of a thick layer of thermal insulation between the self-supporting metal tank and the interior hull of the ship. In one embodiment, a lateral wall of the metal tank is pierced with an exhaust orifice opening into a pipe connecting the metal tank to a pump sump by means of a pickup pipe and control valves or cocks. In another embodiment, a bottom wall of the metal tank is pierced with an orifice opening into a pipe connecting the metal tank to a pump sump via a pickup pipe and control valves or cocks. A centrifugal pump arranged in the pump sump allows the liquid to be displaced by causing it to pass through a riser intended to be connected to an on-shore facility. The pump sump, the centrifugal pump and the riser are arranged outside the metal tank, notably between two walls of a transverse bulkhead of the ship where they are readily accessible.

SUMMARY

One idea underlying the invention is that of providing a sump structure that is reliable and relatively simple to manufacture in the bottom wall of a membrane-type tank.

According to one embodiment, the invention provides a sealed and insulated tank arranged in a floating double hull, the tank comprising tank walls which are fixed to internal walls of the floating double hull, in which tank a tank wall comprises a multilayer structure with multiple layers superposed in a thickness direction including a primary sealing membrane intended to be in contact with a product contained in the tank, a secondary sealing membrane arranged between the primary sealing membrane and the internal wall of the double hull, a secondary thermal insulation barrier arranged between the secondary sealing membrane and the internal wall of the double hull and supporting the secondary sealing membrane, and a primary thermal insulation barrier arranged between the primary sealing membrane and the secondary sealing membrane and supporting the primary sealing membrane, in which an internal bottom wall of the double hull bears a bottom wall of the tank and a sump structure locally interrupting the primary sealing membrane of the bottom wall of the tank, the sump structure comprising a rigid container arranged through the thickness of the bottom wall of the tank and intended to house a suction member of a pump, in which the rigid container comprises a bottom wall situated at a more exterior level than the secondary sealing membrane of the bottom wall of the tank in the thickness direction of the bottom wall of the tank and a peripheral lateral wall connected in a sealed manner to the bottom wall of the tank and extending toward the inside of the tank from the bottom wall of the container at least as far as the primary sealing membrane of the bottom wall of the tank, the peripheral lateral wall having an opening situated opposite the bottom wall of the container and opening to the inside of the tank, in which the sump structure comprises a primary connecting plate surrounding the container, the primary connecting plate having a connecting surface extending parallel to the primary sealing membrane of the bottom wall of the tank, the primary sealing membrane of the bottom wall of the tank being attached in a sealed manner to the connecting surface all around the sump structure.

By virtue of these features it is possible locally to interrupt the primary membrane with the sump structure and to connect the primary sealing membrane flat to the primary connecting plate. In addition, a relatively large-capacity container can be obtained thanks to the positioning of its bottom wall.

According to some embodiments, such a tank may have one or more of the following features.

According to one embodiment, the sump structure further comprises a support base to support equipment in the sealed tank, the support base comprising a hollow shell having a longitudinal axis substantially perpendicular to the internal bottom wall of the double hull, a first longitudinal end of the hollow shell bearing against the internal bottom wall of the double hull and a second longitudinal end of the hollow shell projecting into the tank to support the equipment some distance away from the primary sealing membrane, the container of the sump structure being fixed inside the hollow shell, the primary connecting plate being arranged between the first longitudinal end and the second longitudinal end of the hollow shell and having an internal edge connected in a sealed manner to the hollow shell all around the hollow shell.

The lateral wall of the container may be produced in various ways, for example partially or completely separately from the hollow shell and/or partially or completely combined with the hollow shell.

According to corresponding embodiments, the peripheral lateral wall of the container is housed in the hollow shell over at least a lower part of the container and/or the peripheral lateral wall of the container is made up of the hollow shell over at least an upper part of the container.

According to one embodiment, the sump structure further comprises a secondary connecting plate arranged between the primary connecting plate and the first longitudinal end of the hollow shell and having an internal edge connected in a sealed manner to the hollow shell all around the hollow shell, the secondary connecting plate having a connecting surface running parallel to the secondary sealing membrane of the bottom wall of the tank, the secondary sealing membrane of the bottom wall of the tank being attached in a sealed manner to the connecting surface all around the sump structure.

By virtue of these features, it is possible locally to interrupt the secondary sealing membrane by the sump structure and to connect the secondary sealing membrane flat to the secondary connecting plate.

According to one embodiment, the sump structure additionally comprises a secondary sealing wall fixed inside the hollow shell on the outside of the container and delimiting a primary space inside the hollow shell between the container and the secondary sealing wall, and a porous insulating packing arranged inside the primary space inside the hollow shell.

According to one embodiment, the secondary sealing wall forms a second container having an interior space in which a lower portion of the first container of the sump structure is arranged.

According to one embodiment, the primary connecting plate has an internal edge connected in a sealed manner to the peripheral lateral wall of the container all around the container.

According to one embodiment the sump structure further comprises a secondary connecting plate arranged between the primary connecting plate and the bottom wall of the container and having an internal edge connected in a sealed manner to the peripheral lateral wall of the container all around the container, the secondary connecting plate having a connecting surface running parallel to the secondary sealing membrane of the bottom wall of the tank, the secondary sealing membrane of the bottom wall of the tank being attached in a sealed manner to the connecting surface all around the sump structure.

According to one embodiment, the sump structure further comprises a second container having an interior space in which a lower portion of the container of the sump structure is arranged, the second container comprising a bottom wall arranged at the same level as the bottom wall of the first container in the thickness direction of the bottom wall of the tank or at a level further toward the outside than the bottom wall of the first container, the second container comprising a peripheral lateral wall connected in a sealed manner to the bottom wall of the second container and extending toward the inside of the tank from the bottom wall of the second container at least as far as the secondary sealing membrane of the bottom wall of the tank, and in which the sump structure further comprises a secondary connecting plate arranged between the primary connecting plate and the bottom wall of the second container and having an internal edge connected in a sealed manner to the peripheral lateral wall of the second container all around the second container, the secondary connecting plate having a connecting surface extending parallel to the secondary sealing membrane of the bottom wall of the tank, the secondary sealing membrane of the bottom wall of the tank being attached in a sealed manner to the connecting surface all around the sump structure.

According to one embodiment, the bottom wall of the first container and the bottom wall of the second container are formed by a single sealed plate to which the peripheral lateral wall of the first container and the peripheral lateral wall of the second container surrounding the peripheral lateral wall of the first container are connected.

According to another embodiment, the bottom wall of the second container is spaced away from the bottom wall of the first container in the thickness direction of the bottom wall of the tank.

For preference, in this case, a support element may be arranged between the bottom wall of the two containers in order to increase the support of the first container. According to a corresponding embodiment, the lateral peripheral wall of the first container is extended beyond the bottom wall of the first container in the thickness direction of the bottom wall of the tank and bears against the bottom wall of the second container.

According to one embodiment, a porous insulating packing is arranged in a primary space delimited between the first container and the second container, notably between the peripheral lateral walls thereof.

According to one embodiment, a block of insulating material is arranged on the internal bottom wall of the double hull, the block of insulating material comprising an upper surface opposite to the internal bottom wall of the double hull, the bottom wall of at least one of the first and second containers bearing against the upper surface of the block of insulating material.

According to one embodiment, the sump structure further comprises a hollow extension structure fixed as a projection on an exterior surface of the internal bottom wall of the double hull, the internal bottom wall of the double hull further comprising an opening into an internal space of the hollow extension structure, said opening having the container of the sump structure passing through it such that the bottom wall of the container is situated in the internal space of the extension structure at a level that is further toward the outside than the internal bottom wall of the double hull in the thickness direction of the bottom wall of the tank.

For preference, thermally insulating materials are housed in the internal space of the hollow extension structure around the first and, where applicable, second container. There are a number of options for this.

According to one embodiment, a block of insulating material is arranged on a bottom wall of the extension structure, the block of insulating material comprising an upper surface opposite to the bottom wall of the extension structure, the bottom wall of at least one of the first and second containers bearing against the upper surface of the block of insulating material.

According to one embodiment, support bases extend the lateral peripheral wall of the second container beyond the bottom wall of the second container in the thickness direction of the bottom wall of the tank and bear against a bottom wall of the extension structure.

According to one embodiment, a porous insulating packing is arranged in a secondary space delimited between the peripheral lateral wall of the second container and a peripheral lateral wall of the extension structure.

According to one embodiment, the peripheral lateral wall of the container of the sump structure comprises a flared upper portion projecting above the primary sealing membrane of the bottom wall of the tank.

According to one embodiment, the flared upper portion is equipped with a through-orifice and with a nonreturn valve associated with the orifice and having a direction of opening oriented in the direction of the inside of the container.

The containers and the extension structure may be produced in various forms, notably according to the desired capacity and the space available or constraints regarding size. According to one embodiment, of the following: the bottom wall of the first container, the bottom wall of the second container and the bottom wall of the extension structure, at least one or each is parallel to the internal bottom wall of the double hull.

The capacity of the sump container may be selected according to various criteria, notably the delivery rate of the pump and the target specifics of the application, notably whether or not there is any swell, whether or not there is a need to completely empty the tank in order to be able to charge a cargo having a different chemical composition (through misuse of language mention is made of multigas or monogas applications when the chemical compounds are being transported in liquid state at their liquefaction temperatures). By way of example, a typical period for the swell is of the order of 15 s, which means that one criterion for the sizing of the sump that is applicable in this case is that it be able to contain a sufficient volume of liquid to sustain the delivery rate of the pump over the course of this period, namely at least 62.5 liters for a delivery rate of the order of 15 $m^3$/hour, as well as a remnant of liquid in the sump in order to guarantee correct operation of the pump. This value varies according to the application and according to the specifics of the pump.

There are numerous possible ways of achieving the multilayer structure for the tank wall.

According to one embodiment, the primary thermal insulation barrier and the secondary thermal insulation barrier are essentially made up of parallelepipedal blocks of polyurethane foam, the secondary sealing membrane is made of sealed composite plies assembled by bonding and the primary sealing membrane is achieved using embossed metal sheets welded together. Other details regarding the creation of such a multilayer structure may be found for example in publication FR-A-2781557.

According to one embodiment, the primary thermal insulation barrier and the secondary thermal insulation barrier are essentially made up of parallelepipedal blocks of polyurethane foam, the secondary sealing membrane is produced using embossed metal sheets welded together and the primary sealing membrane is produced using embossed metal sheets welded together. Other details regarding the creation of such a multilayer structure may be found for example in publication FR-A-2996520.

According to one embodiment, the primary thermal insulation barrier and the secondary thermal insulation barrier are essentially made up of parallelepipedal wooden boxes filled with an insulating packing, and the primary and secondary sealing membranes are made up of strakes made from an alloy having a low coefficient of expansion which are welded together parallel to one another at the turned-up edges to form expansion gussets. Further details regarding the creation of such a multilayer structure may be found for example in publication FR-A-2798902.

Such a tank may be installed in a floating, in-shore or off-shore structure, notably a methane carrier ship, a floating storage and regasification unit (FSRU), a floating production storage and offloading (FPSO) unit and the like.

According to one embodiment, a ship for transporting a cold liquid product comprises a double hull and an aforementioned tank arranged in the double hull.

According to one embodiment, the invention also provides a method for loading or unloading such a ship, in which a cold liquid product is conveyed through insulated pipes from or to a floating or on-shore storage facility to or from the tank of the ship.

According to one embodiment, the invention also provides a transfer system for transferring a cold liquid product, the system comprising the aforementioned ship, insulated pipes arranged in such a way as to connect the tank installed in the hull of the ship to a floating or on-shore storage facility and a pump for driving a stream of cold liquid product through the insulated pipes from or toward the floating or on-shore storage facility to or from the tank of the ship.

BRIEF DESCRIPTION OF THE FIGURES

The invention will be better understood and further objects, details, features and advantages thereof will become more clearly apparent during the course of the following description of a number of particular embodiments of the invention which are given solely by way of illustrative and nonlimiting example, with reference to the attached drawings.

DETAILED DESCRIPTION OF EMBODIMENTS

In the description below, various sump structures that can be used in the bottom wall of a tank for storing and/or carrying an NLG will be described. The bottom wall denotes a wall, preferably planar overall, situated in the bottom of the tank with respect to the earth's gravitational field. The overall geometry of the tank may incidentally be of various types. Polyhedral geometries are the most commonplace. A cylindrical, spherical or some other geometry is also possible.

The walls of the tank are formed by a multilayer structure which is fixed to bearing walls and includes two sealing membranes alternating with two thermally insulating barriers. Given that there are numerous known techniques for creating these multilayer structures, the description hereinbelow will confine itself to the sump structure and the zone of wall situated in the immediate vicinity of the sump structure.

Figure 1:
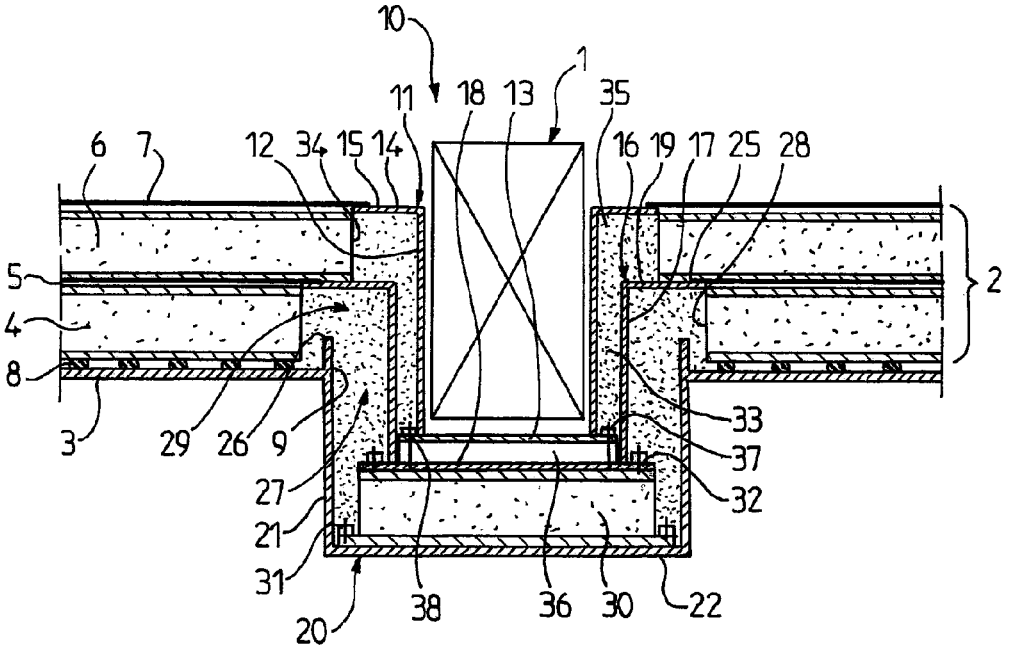
FIG. 1 is a planar schematic view in cross section of a bottom wall of a tank equipped with a sump structure according to a first embodiment.

With reference to FIG. 1, a suction head of a pump depicted schematically by the numeral 1 is housed in a sump structure 10 arranged in a tank wall 2 situated in the bottom of the tank.

The tank wall 2 is mounted on a planar bearing wall 3 made for example of thick steel plate such as the internal hull of a double hull ship. The tank wall 2 has a multilayer structure including in succession a secondary insulating barrier 4 fixed to the bearing wall 3, for example by beads of mastic 8, a secondary sealing membrane 5 supported by the secondary insulating barrier 4, a primary insulating barrier 6 covering the secondary sealing membrane 5 and a primary sealing membrane 7 supported by the primary insulating barrier 6.

At the site of the sump structure 10, the bearing wall 3 has a circular opening 9 through which the sump structure 10 is engaged and which allows the sump structure 10 to protrude externally beyond the bearing wall 3 in the thickness direction of the tank wall 2.

A hollow cylindrical bowl 20 is fixed to the bearing wall 3 around the opening 9 and projects toward the outside of the bearing wall 3 to form an extension structure which provides an additional space in which to house the sump structure 10. More specifically, the hollow cylindrical bowl 20 comprises a cylindrical lateral wall 21, for example circular or the like, an upper edge of which is welded to the bearing wall 3 all around the opening 9, and a flat bottom wall 22, for example circular or the like, welded to a lower edge of the cylindrical lateral wall 21 and arranged parallel to the bearing wall 3. The hollow cylindrical bowl 20 may be made from similar materials to the bearing wall 3.

In order to prevent the hollow cylindrical bowl 20 from having a tendency to collect liquids accidentally present in the secondary insulating barrier 4, such as condensation water or water originating from deficiencies in sealing in the region of the ballast, a lip 26 protruding toward the inside of the tank is preferably provided on the bearing wall 3 all around the opening 9.

The sump structure 10 comprises a primary cylindrical bowl 11, which provides a first container in communication with the inside of the tank, and a secondary cylindrical bowl 16 which provides a second container surrounding the lower part of the first container. The primary cylindrical bowl 11 is connected continuously to the primary membrane 7, which it thus completes in a sealed manner. Likewise, the secondary cylindrical bowl 16 is connected continuously to the secondary membrane 5, which it thus completes in a sealed manner.

More specifically, the primary cylindrical bowl 11 comprises a cylindrical lateral wall 12 the axis of which is perpendicular to the bearing wall 3 and which has an upper edge essentially aligned with the sealing membrane 7 and a lower edge engaged in the hollow cylindrical bowl 20 below the bearing wall 3. A bottom wall 13 parallel to the bearing wall 3 closes the cylindrical lateral wall 12 at its lower edge. A planar annular lip 14 is fixed to the upper edge of the cylindrical lateral wall 12 and projects radially toward the outside thereof all around the primary cylindrical bowl 11.

The primary membrane 7 thus has an interruption in the form of a window, for example a circular or square window, the edge 15 of which surrounds the sump structure 10 and is connected in a sealed manner to the upper surface of the flat lip 14, for example by welding or bonding.

Similarly, the secondary cylindrical bowl 16 comprises a cylindrical lateral wall 17 the axis of which is perpendicular to the bearing wall 3 and which has an upper edge essentially aligned with the secondary sealing membrane 5 and a lower edge engaged in the hollow cylindrical bowl 20 below the bottom wall 13. A bottom wall 18 parallel to the bearing wall 3 closes the cylindrical lateral wall 17 at its lower edge. The cylindrical lateral wall 17 surrounds the cylindrical lateral wall 12 at some distance therefrom. A planar annular lip 19 is fixed to the upper edge of the cylindrical lateral wall 17 and projects radially outward therefrom all around the secondary cylindrical bowl 16.

The secondary membrane 5 thus has an interruption in the form of a window, for example a circular or square window, the edge 25 of which surrounds the sump structure 10 and is connected in a sealed manner to the upper surface of the flat lip 19, for example by welding or bonding.

In the tank wall 2, the space comprised between the bearing wall 3 and the secondary membrane 5 is a secondary space containing the secondary insulating barrier 4 and in which it is possible to circulate a stream of nitrogen as a safety precaution. In the sump structure 10, the space comprised between the secondary cylindrical bowl 16 and the hollow cylindrical bowl 20 is also a secondary space 27 which communicates with the secondary space of the wall of the tank 2 in order to receive this sweep of nitrogen.

The secondary insulating barrier 4 is, for example, made up of modular blocks juxtaposed to line the bearing wall 3 relatively uniformly. These modular blocks stop a certain distance away from the sump structure 10, as indicated by the edge 28. Insulating blocks of suitable shape can be designed in order to come up relatively close to the sump structure 10 or fit into the latter thus limiting the gap still to be filled in the secondary insulation. Insulating materials are housed in the gap 29 between the edge 28 of the secondary insulating barrier 4 and the secondary cylindrical bowl 16, and in the secondary space 27 of the sump structure 10 to complete the thermal insulation around the secondary cylindrical bowl 16. Specifically, the secondary membrane 5 and the secondary cylindrical bowl 16 are liable to be in contact with the LNG in the event of an accidental leak in the primary membrane 7.

There are various insulating materials that may be suitable for thus completing the secondary thermal insulation, for example glass wool or rock wool, polymer foams, notably polyurethane or PVC foams, balsa wood, plywood, aerogels and the like.

For preference, the insulating materials housed between the bottom wall 22 and the bottom wall 18 also have sufficient rigidity to structurally support the secondary cylindrical bowl 16 and the primary cylindrical bowl 11. For that, in FIG. 1, a relatively rigid insulating panel 30 is housed between the bottom wall 22 and the bottom wall 18, this being produced for example in the form of a block of polyurethane foam sandwiched between two sheets of plywood. The insulating panel 30 is fixed to the bottom wall 22, for example using fixing devices 31 comprising threaded studs fixed so that they project from the bottom wall 22 and engaging in orifices made in a peripheral zone of the lower sheet of plywood, with nuts screwed onto the studs.

The bottom wall 18 is fixed to the top of the insulating panel 30, for example using similar fixing devices collaborating with a peripheral lip 32 of the bottom wall 18 which protrudes radially beyond the lateral wall 17.

Similarly, in the tank wall 2, the space comprised between the secondary membrane 5 and the primary membrane 7 is a primary space containing the primary insulating barrier 6 and in which is it possible to circulate a stream of nitrogen as a safety precaution. In the sump structure 10, the space comprised between the primary cylindrical bowl 11 and the secondary cylindrical bowl 16 is also a primary space 33 which communicates with the primary space of the tank wall 2 in order to be able to receive this sweep of nitrogen.

The primary insulating barrier 6 is, for example, made up of modular blocks which are juxtaposed to line the bearing walls 3 relatively uniformly. These modular blocks stop a certain distance away from the sump structure 10, as indicated by the edge 34. Insulating blocks of suitable shape may be designed in order to get up relatively close to the sump structure 10 or fit into the latter and thus limit the gap still to be filled in the primary insulation. Insulating materials are housed in the gap 35 between the edge 34 of the primary insulating barrier 6 and the primary cylindrical bowl 11, as well as in the primary space 33 of the sump structure 10 in order to complete the thermal insulation around the primary cylindrical bowl 11. This is because the primary membrane 7 and the primary cylindrical bowl 11 are in contact with the LNG during use.

There are various insulating materials that may be suitable for thus completing the primary thermal insulation, for example glass wool or rock wool, polymer foams, notably polyurethane or PVC foams, balsa wood, plywood, aerogels and the like.

For preference, the insulating materials housed between the bottom wall 18 and the bottom wall 13 also have sufficient rigidity to structurally support the primary cylindrical bowl 11. For that, in FIG. 1, a relatively rigid insulating panel 36 is housed between the bottom wall 18 and the bottom wall 13, this being produced for example in the form of a block of plywood. The insulating panel 36 is fixed to the bottom wall 18, for example using fixing devices 37 comprising threaded studs projecting from the bottom wall 18 and engaging in orifices made in a peripheral zone of the block of plywood and nuts screwed onto the studs.

The bottom wall 13 is fixed on top of the insulating panel 36 by the fixing devices 37 collaborating with a peripheral lip 38 of the bottom wall 13 which protrudes radially beyond the lateral wall 12.

In operation, because of its position underneath the primary membrane 7, the primary bowl 11 receives under gravity any residual liquid lying in the tank, in the manner of a sump. The primary bowl 11 has sufficient capacity to keep the suction head of the pump 1 immersed in the liquid for a certain period of time, for example of the order of 15 s or more.

In order to have good structural stability, the primary bowl 11 and the secondary bowl 16 are made from a more rigid material than the sealing membranes, for example using metal sheet of the order of 6 to 20 mm in thickness.

Figure 2:
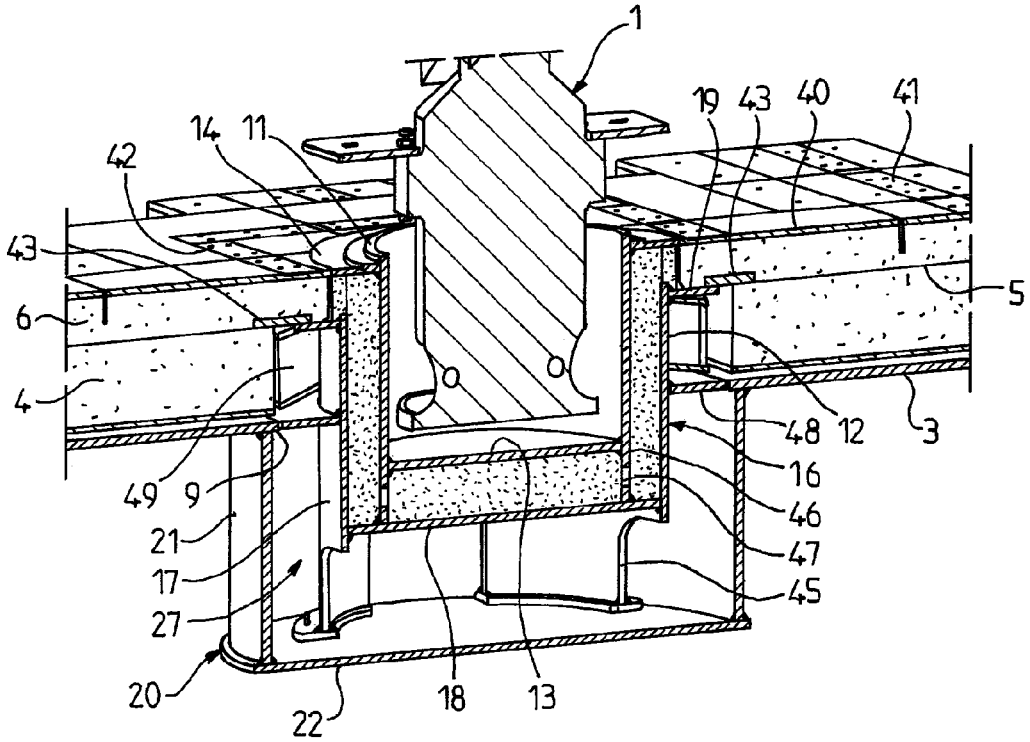
FIG. 2 is a schematic perspective view in cross section of a bottom wall of a tank equipped with a sump structure according to a second embodiment, in which figure insulating packing has been omitted in order to allow the internal space of the extension structure to be seen.
Figure 3:
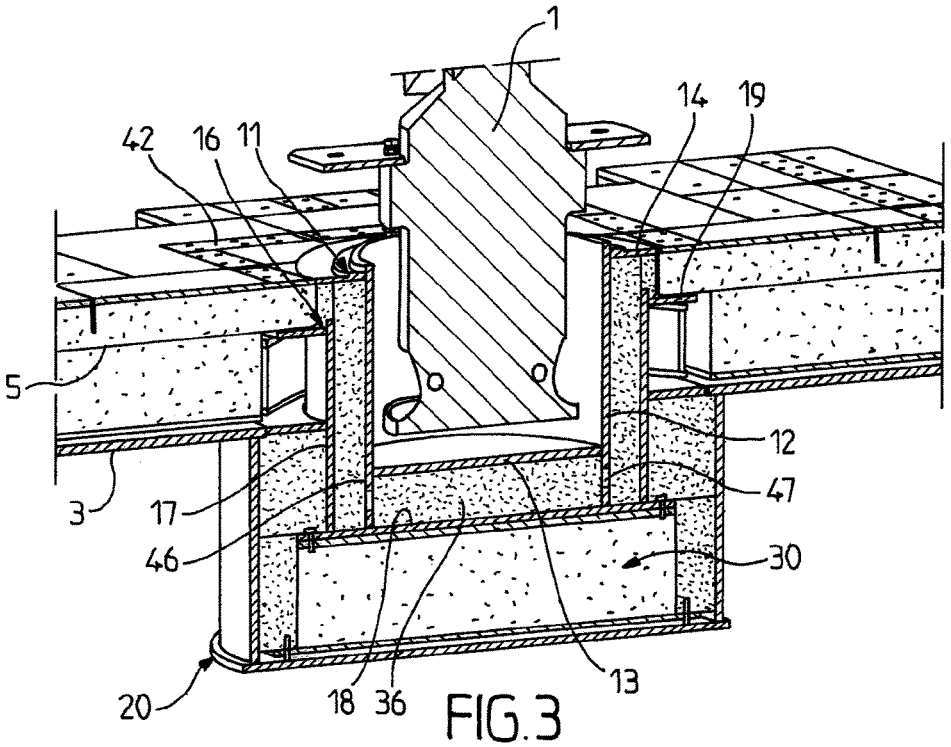
FIG. 3 is a schematic and perspective view in cross section of a bottom wall of a tank equipped with a sump structure according to a third embodiment.
Figure 4:
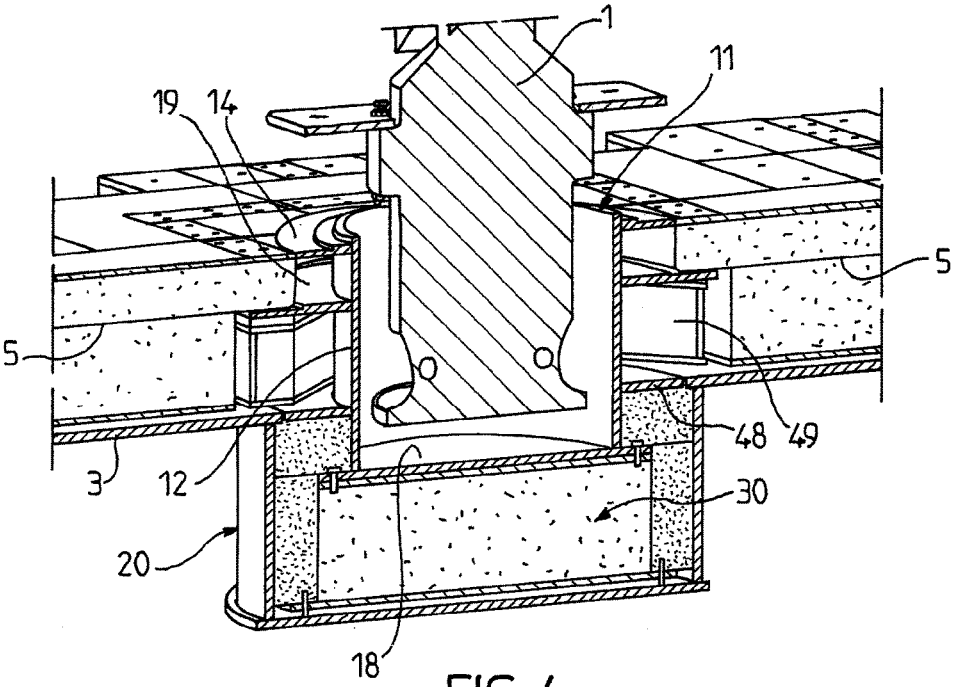
FIG. 4 is a schematic perspective view in cross section of a bottom wall of a tank equipped with a sump structure according to a fourth embodiment.

With reference to FIGS. 2 to 4, other embodiments of the sump structure will now be described, these being more particularly suited to a tank wall produced using the technology described in publications FR-A-2781557 or FR-A-2961580. Elements analogous or identical to those of FIG. 1 bear the same reference numeral and are described again only insofar as they differ from FIG. 1.

In this case, the primary insulation barrier 6 is essentially made up of slabs of polyurethane foam covered with sheets of plywood 40 forming the primary membrane support surface. The primary membrane, which has been omitted from FIGS. 2 to 4, is made up of thin sheets of embossed metal plate known from elsewhere. To fix the embossed metal plates to the sheets of plywood 40, the latter are fitted with metal plates 41, 42 fixed into spot faces on the tops of the sheets of plywood 40.

The structure of the primary membrane in the immediate vicinity of the sump structure can be produced in the same way as the connection between the primary membrane and the support base as taught in publication FR-A-2961580.

More specifically, metal plates 42 fixed to the sheets of plywood 40 surround the flat annular lip 14 of the sump structure a small distance therefrom, thereby forming for example a square outline for the sake of simplicity. Closure plates which have not been depicted are arranged around the flat annular lip 14 and are welded in a sealed manner thereto around the entire periphery thereof. For that, the closure plates are cut in a semicircle on their interior edge, while their exterior edge delimits a square that becomes superposed with the metal plates 42 all around the sump structure so as to be fixed by welding to the metal plates 42. The primary sealing barrier in the sump zone 10 is supplemented, on the one hand, by welding the edges of embossed metal sealing plates to the closure plates and on the other hand by sealing closed any ends of corrugations that may be interrupted at this point.

The structure of the secondary membrane in the immediate vicinity of the sump structure may be achieved in exactly the same way as the connection between the secondary membrane and support base as taught in publication FR-A-2961580 by forming the lip 19 with a square contour. In particular, the secondary membrane is made up of a sealed composite ply 5 bonded to the modular blocks of polyurethane foam that constitutes the secondary insulating barrier 4. To ensure the continuity of the secondary sealing barrier around the sump structure, four strips 43 of a sealed composite material made of an aluminum and fiber glass foil are bonded to the flat lip 19 and to the sealed composite ply 5. A strip 43 is positioned so that it, on each occasion, straddles one side of the lip 19 and the edge of the sealed composite ply 5.

Alternatively, the flat lip 19 may be formed with a circular contour. In that case, the structure of the secondary membrane in the immediate vicinity of the sump structure may be produced in the same way as the connection between the secondary membrane and the support base as taught in French application FR3002515 filed on Feb. 22, 2013 under application number 1351584.

The embodiment of FIG. 2 also shows special arrangements for the support of the primary bowl 11 and of the secondary bowl 16. In particular, the support bases 45 extend the lateral wall 17 of the secondary bowl 16 in such a way as to bear against the bottom wall 22. As a result, the insulating materials housed in the secondary space 27 and not depicted in FIG. 2 do not need to offer as much structural rigidity as the insulating panel 30 and may be made of softer materials.

Likewise, a support wall 46 extends the lateral wall 12 of the primary bowl 11 in such a way as to bear against the bottom wall 18. As a result, the insulating materials housed in the primary space 33 and not depicted in FIG. 2 do not need to offer as much structural rigidity as the insulating panel 36 and can be made of softer materials. Orifices 47 in the support wall 46 allow a gaseous phase to circulate in the primary space.

Moreover, an annular lip 48 is positioned around the lateral wall 17 to offer an additional support surface in the alignment of the bearing wall 3, notably in order to support small insulating blocks 49 of a shape suited to closely surrounding the lateral wall 17. The annular lip 48 may be fixed to the bearing wall 3 and/or to the lateral wall 17.

The embodiment of FIG. 3 is similar to that of FIG. 2 but comprises the lower insulating block 30 instead of, or in combination with, the support bases 45.

In an alternative form that has not been depicted, for the sake of simplification, one and the same wall 18 may form the bottom of the primary bowl 11 and of the secondary bowl 16. For that, by comparison with FIG. 3, the wall 13 and the insulating panel 36 are omitted and the orifices 47 are plugged. This then yields a secondary bowl which does not pass below the primary bowl 11 but which only goes around same.

An additional level of simplification is obtained in the embodiment of FIG. 4 in which the secondary bowl is completely omitted. The flat lip 19 is fixed directly around the lateral wall 12 of the primary bowl 11, for example by welding.

Figure 5:
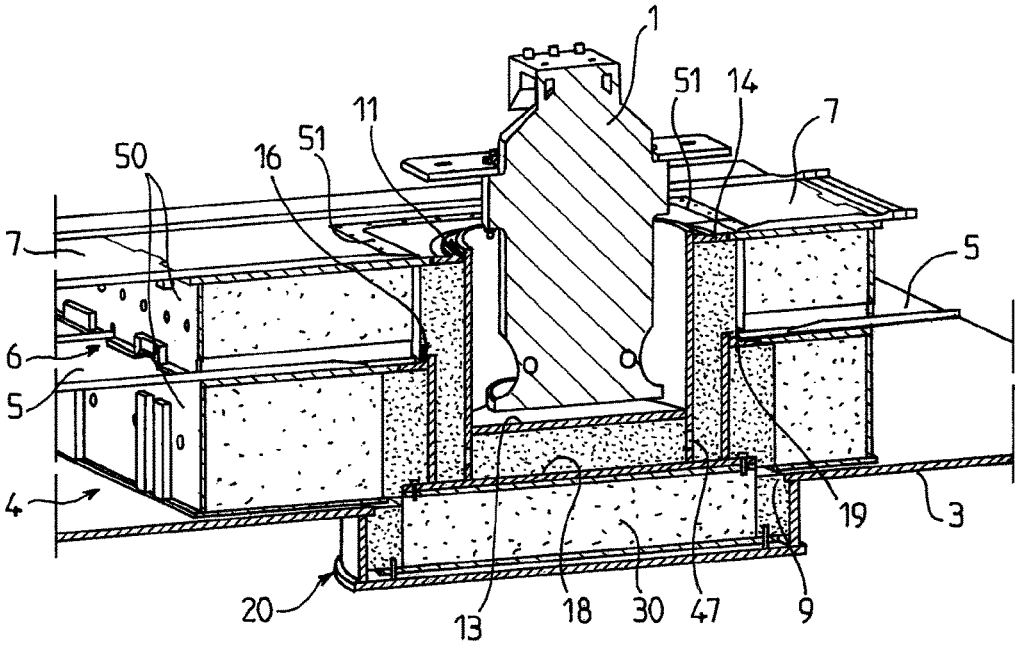
FIG. 5 is a schematic perspective view in cross section of a bottom wall of a tank equipped with a sump structure according to a fifth embodiment.

The embodiment of FIG. 5 differs from FIG. 3 in two respects.

On the one hand, the hollow cylindrical bowl 20 is not as deep, in order to limit the bulk of the sump structure on the outside of the bearing wall 3. Thus, the bottom wall 18 of the secondary bowl 16 here is on the inside of the bearing wall 3.

On the other hand, the sump structure 10 is used here in combination with a tank wall produced according to the technology described in publication FR-A-2798902. Elements that are analogous or identical to those of FIG. 1 bear the same reference numeral and are described only insofar as they differ from FIG. 1.

In this case, the primary insulation barrier 6 and the secondary insulation barrier 4 are essentially made up of plywood boxes 50 filled with an insulating packing, for example made of perlite, glass wool or the like. The primary membrane 7 and the secondary membrane 5 are made of parallel strakes with turned-up edges made of a steel with a low expansion coefficient known by the name of Invar® which are held on the cover panels of the plywood boxes 50 by means of elongate weld supports.

Around the primary bowl lithe strakes of the primary membrane 7 are cut to form a square window 51. The continuity of the primary membrane 7 between the edge of the window 51 and the flat lip 14 may be achieved by means of closure plates as described hereinabove.

Figure 6:
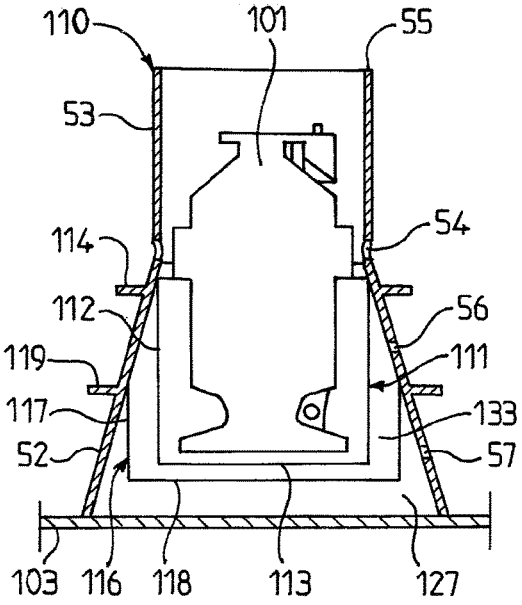
FIG. 6 is a planar schematic view in cross section of a sump structure according to a sixth embodiment.
Figure 7:
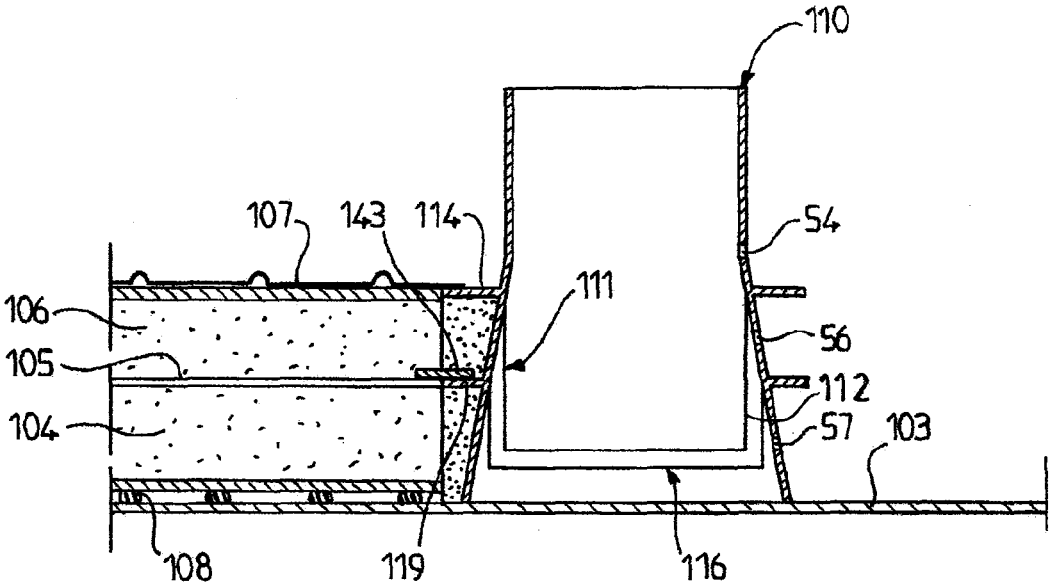
FIG. 7 is a view similar to FIG. 6, in which the sump structure is shown as assembled with the bottom wall of the tank.
Figure 8:
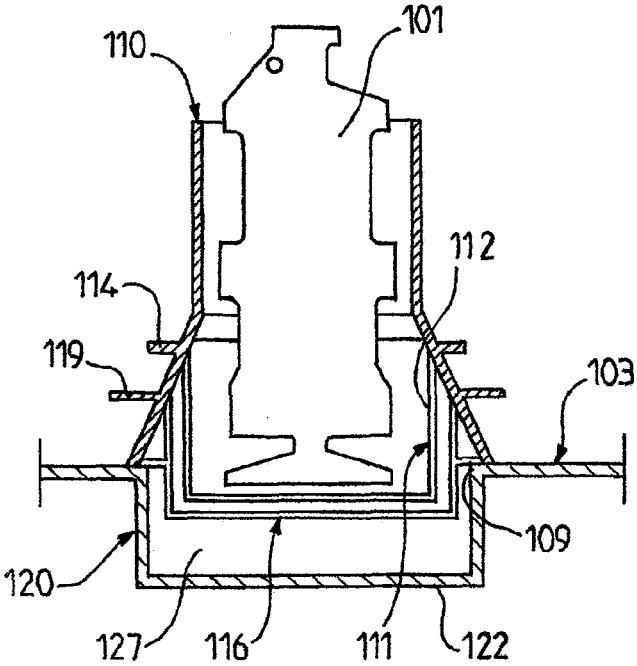
FIG. 8 is a planar schematic view in cross section of a bottom wall of a tank equipped with a sump structure according to a seventh embodiment.

The embodiments of FIGS. 6 to 8 relate to a sump structure which jointly creates a support base 110. Elements that are analogous or identical to those of FIG. 1 bear the same reference numeral increased by 100 and are described only insofar as they differ from FIG. 1.

For the sake of clarity, the tank wall has been omitted from FIG. 6. The support base 110 has a shape which is a hollow of revolution with a frustoconical lower part 52 flaring out downward for the sake of stability and bearing against the bearing wall 3, and a straight upper part 53. The opening 9 is omitted in the embodiment of FIG. 6. The primary bowl 111 has a diameter similar to the straight upper part 53 and is fixed in the continuation thereof inside the frustoconical lower part 52. More specifically, an upper edge of the lateral wall 112 is fixed in a sealed manner to the interior surface of the frustoconical lower part 52 all around the support base 110. The secondary bowl 116 has a greater diameter and is fixed underneath the primary bowl 111 inside the frustoconical lower part 52. More specifically, an upper edge of the lateral wall 117 is fixed in a sealed manner to the interior surface of the frustoconical lower part 52 all around the support base 110.

On its exterior surface, the support base 110 bears the flat lip 114 more or less at the same level as the upper edge of the primary bowl 111 and the flat lip 119 more or less at the same level as the upper edge of the secondary bowl 116. As before, the flat lips 114 and 119 are used for attaching the primary and secondary sealing membranes (not depicted) in a sealed manner around the support base 110.

Inlet orifices 54 are formed through the wall of the support base 110 slightly above the lip 114, so that they lie slightly above the primary sealing membrane. They allow liquid to be collected in the primary bowl 111 under gravity even when the fill level of the tank is below the top 55 of the support base 110.

Similarly, circulation orifices 56 and 57 are formed through the wall of the support base 110 between the lips 114 and 119 and under the lip 119 so as to allow the gaseous phase to pass between the primary space of the tank wall and the primary space 133 of the support base 110 and, respectively, between the secondary space of the tank wall and the secondary space 127 of the support base 110.

How the connections between a support base and the primary membrane and secondary membrane of a tank wall are embodied has been described in publication FR-A-2961580. Such connections are applicable to the support base 110.

FIG. 7 schematically illustrates another way of making these connections. In this embodiment, the tank wall has a structure similar to FIG. 2. Elements that are analogous or identical to those of FIG. 2 bear the same reference numeral increased by 100. In this case, the edges of the sheet metal plates that form the primary sealing membrane 7 are welded directly to the flat lip 114 all around the support base 110. Moreover, sealed composite strips 143 are bonded to straddle the flat lip 119 and the sealed ply 5 of the adjacent modular blocks all around the support base 110.

In FIGS. 6 and 7, between the upper edge of the lateral wall 112 and the inlet orifices 54, the wall of the support base 110 thus extends the wall of the primary bowl 111 in a sealed manner. The primary bowl 111 and this portion of the wall of the support base 110 thus together form a sealed container, the wall of the support base 110 of which forms the upper part.

In order to increase the capacity of the primary bowl 111, it is possible to combine the support base 110 with a hollow cylindrical bowl 120 extending on the outside of the bearing wall 103. This combination is illustrated schematically in FIG. 8. Thus, the bottom wall of the primary bowl 111 can be moved away to outside of the bearing wall 103 in order to increase the capacity of the bowl.

Another way of adjusting the capacity of the primary bowl 111 is to vary the diameter of the support base 110. In preferred embodiments, this diameter ranges between 0.4 m and 1 m.

Moreover, although the bowls 111 and 116 have been depicted as being completely separate from the support base 110, it is obvious that the lateral wall of the support base 110 could alternatively constitute the lateral wall of the bowl 111 or 116 over at least part of the height thereof. To achieve that all that is required is to provide a bottom wall 113 or 118 that closes off the section of the support base 110 at the desired level.

Figure 9:
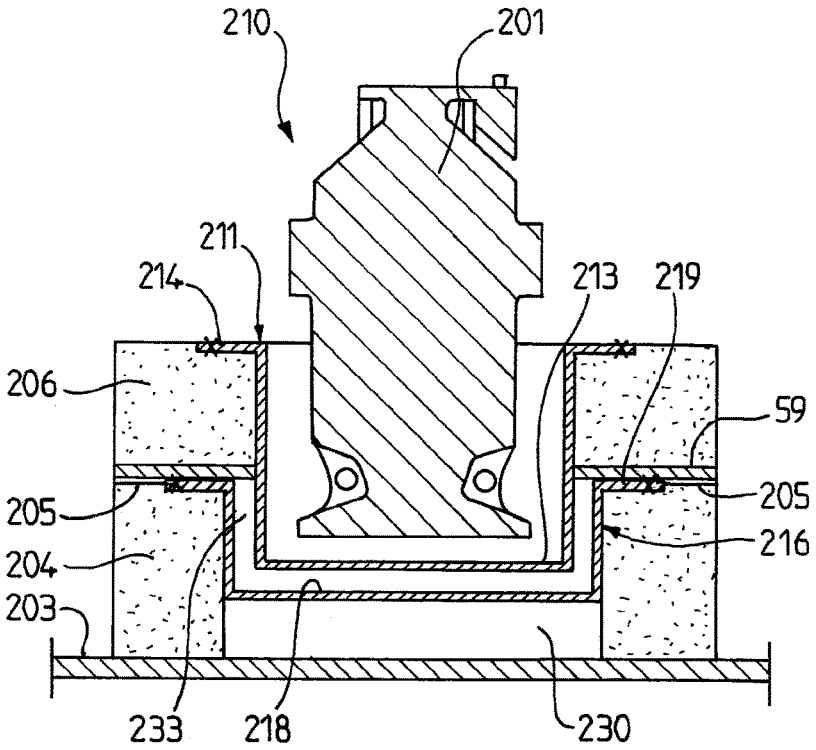
FIG. 9 is a planar schematic view in cross section of a bottom wall of a tank equipped with a sump structure according to an eighth embodiment.
Figure 10:
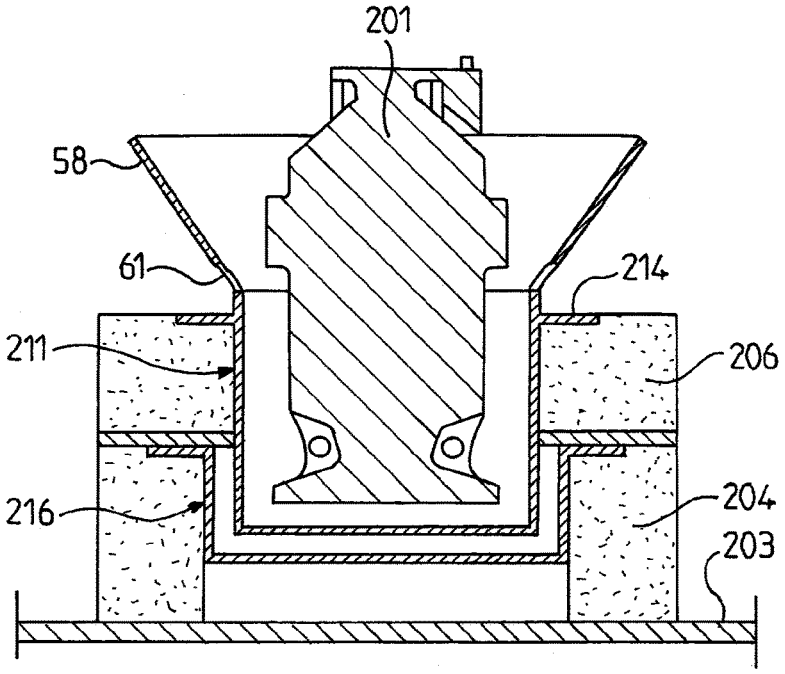
FIG. 10 is a view similar to FIG. 9, in which the sump structure is also provided with a flared collar.

The embodiments of FIGS. 9 and 10 relate to a sump structure that remains inside the bearing wall 203 in order to limit the bulk of the tank. Elements that are analogous or identical to those of FIG. 1 bear the same reference numeral increased by 200 and are described only insofar as they differ from FIG. 1. The primary sealing membrane is omitted.

In the embodiment of FIG. 9, the primary bowl 211 and the secondary bowl 216 are not fixed to one another. The flat lip 214 of the primary bowl 211 bears on a spot face on the top of the modular blocks 206 that form the primary insulating barrier to which it is fixed. Likewise, the flat lip 219 of the secondary bowl 216 bears in a spot face on the top of the modular blocks 204 that form the secondary insulating barrier to which it is fixed. Between the bearing wall 203 and the bottom 218 of the secondary bowl 216, the insulating block 230 of relatively small thickness is preferably made from a material with very high insulating capability, for example aerogels or a vacuum insulation panel. Optionally, a relatively rigid block, not depicted, may be fitted between the bottom 218 and the bottom 213 in order to improve the support of the primary bowl 211.

The secondary sealing membrane 205 is connected in a sealed manner to the flat lip 219. For preference, circulation grooves are formed in the bottom plate 59 of the modular blocks 206, so as to allow the gaseous phase to pass between the primary space of the tank wall and the primary space 233 of the sump structure.

The embodiment of FIG. 10 differs from FIG. 9 only through the addition of a frustoconical upper end piece 58 above the primary bowl 211. This end piece is equipped at its base, just above the primary sealing membrane which has not been depicted, with inlet orifices 61 controlled by nonreturn valves which have not been depicted but which allow the residual liquid present in the bottom of the tank to be captured in the frustoconical upper end piece 58.

The techniques described hereinabove for creating a sump structure can be used in various types of tank, for example an LNG tank of a floating structure such as a methane carrier ship or the like.

Figure 11:
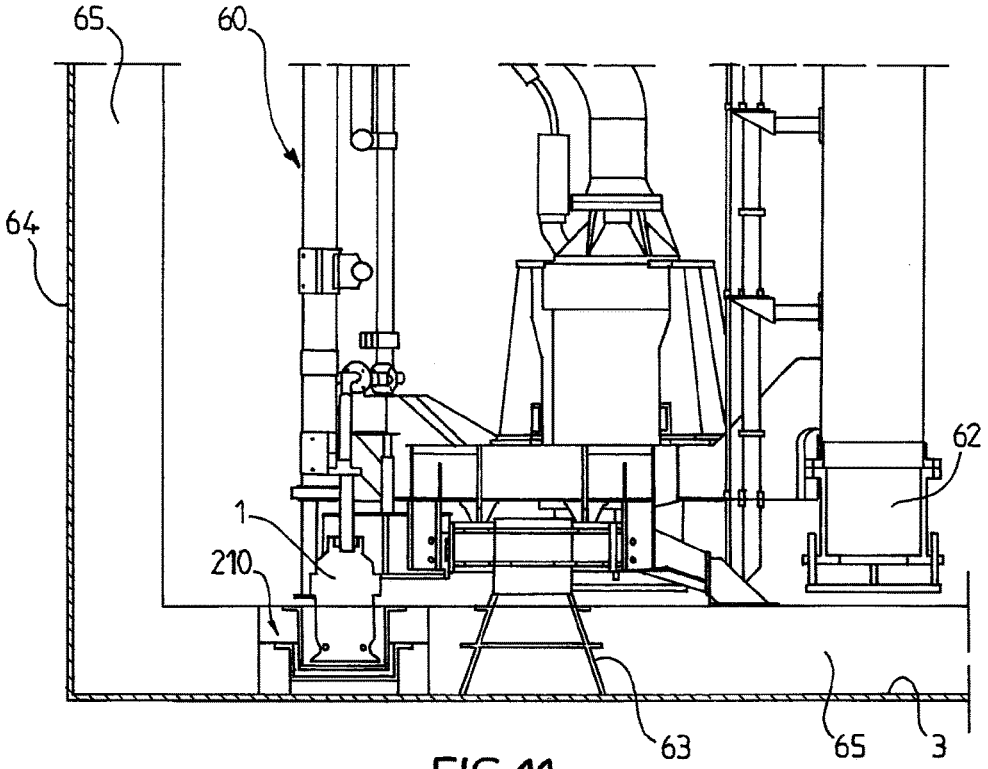
FIG. 11 is a planar schematic view in cross section of a bottom region of a tank situated at the base of an unloading tower and in which sump structures can be used.

FIG. 11 schematically illustrates the installation of a sump structure, here corresponding to the sump structure 210 of FIG. 9, at the base of a loading/unloading tower 60 in a methane carrier ship tank, namely vertically above the liquid dome of the tank. The loading/unloading tower 60 is supported by a support base 63 resting on the bearing wall 3 which is the internal bottom wall of the double hull of the ship. The loading/unloading tower 60 notably comprises a main pump 62 and an auxiliary pump 1 of lower capacity than the main pump 62. The sump structure 210 is designed to house the suction inlet of the auxiliary pump 1. Moreover, because the sump structure is incorporated into the thickness of the tank wall, the tank walls 65 can be produced according to the customary planar multilayer structure, both in terms of the bottom wall 3 and in terms of the transverse cofferdam 64, and connection to the sump structure 210 is obtained without significantly diverting the sealed membranes from their usual planar geometry.

Figure 12:
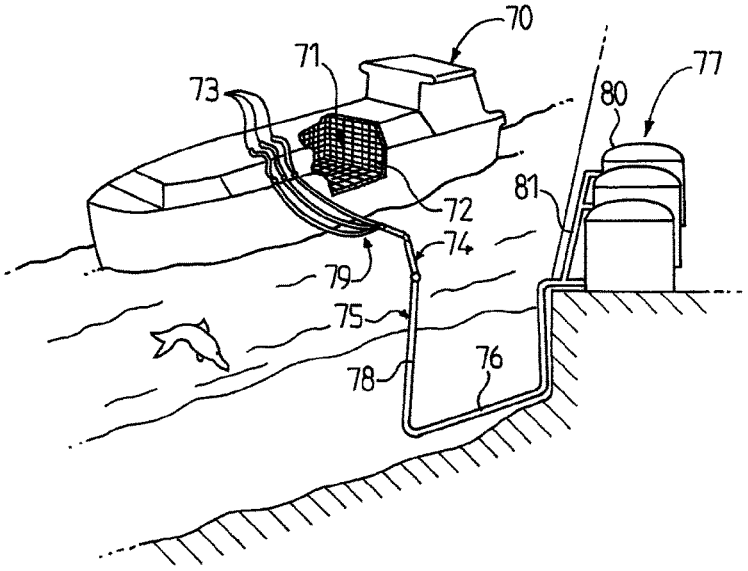
FIG. 12 is a schematic depiction with cutaway of a tank of a methane carrier ship and of a loading/unloading terminal for loading/unloading this tank.

With reference to FIG. 12, a cutaway view of a methane carrier ship 70 shows a sealed and insulated tank 71 of prismatic overall shape mounted in the double hull 72 of the ship. The wall of the tank 71 comprises a primary sealing barrier intended to be in contact with the LNG contained in the tank, a secondary sealing barrier arranged between the primary sealing barrier and the double hull 72 of the ship, and two insulating barriers arranged respectively between the primary sealing barrier and the secondary sealing barrier and between the secondary sealing barrier and the double hull 72.

In a way known per se, loading/unloading pipes 73 arranged on the upper deck of the ship may be connected, by means of suitable connectors, to a maritime or harbor-based terminal in order to transfer a cargo of LNG from or to the tank 71.

FIG. 12 depicts one example of a maritime terminal comprising a loading and offloading station 75, an underwater pipe 76 and an on-shore facility 77. The loading and offloading station 75 is a fixed off-shore facility comprising a mobile arm 74 and a tower 78 supporting the mobile arm 74. The mobile arm 74 carries a bundle of insulated flexible pipes 79 that can be connected to the loading/offloading pipes 73. The orientable mobile arm 74 adapts to suit all sizes of methane carrier ship. A connecting pipe, not depicted, extends along inside the tower 78. The loading and offloading station 75 allows the methane carrier ship 70 to be loaded and offloaded from or to the land-based facility 77. The latter comprises liquefied gas storage tanks 80 and connecting pipes 81 connected by the underwater pipe 76 to the loading or offloading station 75. The underwater pipe 76 allows liquefied gas to be transferred between the loading or offloading station 75 and the on-shore facility 77 over a large distance, for example 5 km, which means that the methane carrier ship 70 can be kept a long distance offshore during the loading and offloading operations.

In order to generate the pressure needed for transferring the liquefied gas, use is made of pumps carried onboard the ship 70 and/or of pumps with which the shore-based facility 77 is equipped and/or of the pumps with which the loading and offloading station 75 is equipped. For unloading the tank, it is notably possible to use the auxiliary pump 1 and/or the main pump 62 which are arranged inside the tank.

Although the invention has been described in conjunction with a number of particular embodiments, it is quite obvious that it is not in any way restricted thereto and that it comprises all technical equivalents of the means described and combinations thereof where these fall within the scope of the invention.

The use of the verbs "comprise", "include" or "have" and conjugated forms thereof does not exclude there being other elements or steps other than those listed in a claim present. The use of the indefinite article "a" or "an" for an element or step does not, unless otherwise mentioned, preclude there being a plurality of such elements or steps.

In the claims, any reference sign between parentheses must not be interpreted as limiting the claim.

The invention claimed is:

1. A sealed and insulated tank equipped with an unloading pump and arranged in a floating double hull, the tank comprising tank walls which are fixed to internal walls of the floating double hull, in which a tank wall comprises a multilayer structure with multiple layers superposed in a thickness direction including a primary sealing membrane intended to be in contact with a product contained in the tank, a secondary sealing membrane arranged between the primary sealing membrane and the internal wall of the double hull, a secondary thermal insulation barrier arranged between the secondary sealing membrane and the internal wall of the double hull and supporting the secondary sealing membrane, and a primary thermal insulation barrier arranged between the primary sealing membrane and the secondary sealing membrane and supporting the primary sealing membrane, in which an internal bottom wall of the double hull bears a bottom wall of the tank and a sump structure locally interrupting the primary sealing membrane of the bottom wall of the tank, the sump structure comprising a rigid container arranged through the thickness of the bottom wall of the tank, the unloading pump being arranged in the tank so that it draws up the product contained in the tank toward the top of the tank, the unloading pump comprising a suction member housed in said rigid container, in which the rigid container comprises a bottom wall situated at a more exterior level than the secondary sealing membrane of the bottom wall of the tank in the thickness direction of the bottom wall of the tank and a peripheral lateral wall connected in a sealed manner to the bottom wall of the container so as to be closed by the bottom wall of the container, the peripheral lateral wall extending toward the inside of the tank from the bottom wall of the container at least as far as the primary sealing membrane of the bottom wall of the tank, the peripheral lateral wall having an opening situated opposite the bottom wall of the container and opening to the inside of the tank, in which the sump structure comprises a primary connecting plate surrounding the container and having an internal edge connected in a sealed manner, directly or indirectly, to the peripheral lateral wall of the container all around the container, the primary connecting plate having a connecting surface extending parallel to the primary sealing membrane of the bottom wall of the tank, the primary sealing membrane of the bottom wall of the tank being attached in a sealed manner to the connecting surface all around the sump structure.

2. The tank as claimed in claim 1, in which the sump structure further comprises a support base to support equipment in the sealed tank, the support base comprising a hollow shell having a longitudinal axis substantially perpendicular to the internal bottom wall of the double hull, a first longitudinal end of the hollow shell bearing against the internal bottom wall of the double hull and a second longitudinal end of the hollow shell projecting into the tank to support the equipment some distance away from the primary sealing membrane, the container of the sump structure being fixed inside the hollow shell, the primary connecting plate being arranged between the first longitudinal end and the second longitudinal end of the hollow shell and having an internal edge connected in a sealed manner to the hollow shell all around the hollow shell.

3. The tank as claimed in claim 2, in which the peripheral lateral wall of the container is housed in the hollow shell over at least a lower part of the container.

4. The tank as claimed in claim 2, in which the peripheral lateral wall of the container is made up of the hollow shell over at least an upper part of the container.

5. The tank as claimed in claim 2, in which the sump structure further comprises a secondary connecting plate arranged between the primary connecting plate and the first longitudinal end of the hollow shell and having an internal edge connected in a sealed manner to the hollow shell all around the hollow shell, the secondary connecting plate having a connecting surface running parallel to the secondary sealing membrane of the bottom wall of the tank, the secondary sealing member of the bottom wall of the tank being attached in a sealed manner to the connecting surface all around the sump structure.

6. The tank as claimed in claim 5, in which the sump structure additionally comprises a secondary sealing wall fixed inside the hollow shell on the outside of the container and delimiting a primary space inside the hollow shell between the container and the secondary sealing wall, and a porous insulating packing arranged inside the primary space inside the hollow shell.

7. The tank as claimed in claim 6, in which the secondary sealing wall forms a second container having an interior space in which a lower portion of the first container of the sump structure is arranged.

8. The tank as claimed in claim 1, in which the sump structure further comprises a secondary connecting plate arranged between the primary connecting plate and the bottom wall of the container and having an internal edge connected in a sealed manner to the peripheral lateral wall of the container all around the container, the secondary connecting plate having a connecting surface running parallel to the secondary sealing membrane of the bottom wall of the tank, the secondary sealing membrane of the bottom wall of the tank being attached in a sealed manner to the connecting surface all around the sump structure.

9. The tank as claimed in claim 1, in which the sump structure further comprises a second container having an interior space in which a lower portion of the container of the sump structure is arranged, the second container comprising a bottom wall arranged at the same level as the bottom wall of the first container in the thickness direction of the bottom wall of the tank or at a level further toward the outside than the bottom wall of the first container, the second container comprising a peripheral lateral wall connected in a sealed manner to the bottom wall of the second container and extending toward the inside of the tank from the bottom wall of the second container at least as far as the secondary sealing membrane of the bottom wall of the tank, and in which the sump structure further comprises a secondary connecting plate arranged between the primary connecting plate and the bottom wall of the second container and having an internal edge connected in a sealed manner to the peripheral lateral wall of the second container all around the second container, the secondary connecting plate having a connecting surface extending parallel to the secondary sealing membrane of the bottom wall of the tank, the secondary sealing membrane of the bottom wall of the tank being attached in a sealed manner to the connecting surface all around the sump structure.

10. The tank as claimed in claim 9, in which the bottom wall of the first container and the bottom wall of the second container are formed by a single sealed plate to which the peripheral lateral wall of the first container and the peripheral lateral wall of the second container surrounding the peripheral lateral wall of the first container are connected.

11. The tank as claimed in claim 9, in which the bottom wall of the second container is spaced away from the bottom wall of the first container in the thickness direction of the bottom wall of the tank.

12. The tank as claimed in claim 11, in which the lateral peripheral wall of the first container is extended beyond the bottom wall of the first container in the thickness direction of the bottom wall of the tank and bears against the bottom wall of the second container.

13. The tank as claimed in claim 9, further comprising a porous insulating packing arranged in a primary space delimited between the first container and the second container.

14. The tank as claimed in claim 8, further comprising a block of insulating material arranged on the internal bottom wall of the double hull, the block of insulating material comprising an upper surface opposite to the internal bottom wall of the double hull, the bottom wall of at least one of the first and second containers bearing against the upper surface of the block of insulating material.

15. The tank as claimed in claim 1, in which the sump structure further comprises a hollow extension structure fixed as a projection on an exterior surface of the internal bottom wall of the double hull, the internal bottom wall of the double hull further comprising an opening opening into an internal space of the hollow extension structure, said opening having the container of the sump structure passing through it such that the bottom wall of the container is situated in the internal space of the extension structure at a level that is further toward the outside than the internal bottom wall of the double hull in the thickness direction of the bottom wall of the tank.

16. The tank as claimed in claim 15, further comprising a block of insulating material arranged on a bottom wall of the extension structure, the block of insulating material comprising an upper surface opposite to the bottom wall of the extension structure, the bottom wall of at least one of the first and second containers bearing against the upper surface of the block of insulating material.

17. The tank as claimed in claim 15, further comprising support bases extending the lateral peripheral wall of the second container beyond the bottom wall of the second container in the thickness direction of the bottom wall of the tank and bearing against a bottom wall of the extension structure.

18. The tank as claimed in claim 16, further comprising a porous insulating packing arranged in a secondary space delimited between the peripheral lateral wall of the second container and a peripheral lateral wall of the extension structure.

19. The tank as claimed in claim 15, in which the bottom wall of the extension structure is parallel to the internal bottom wall of the double hull.

20. The tank as claimed in claim 1, in which the peripheral lateral wall of the container of the sump structure comprises a flared upper portion projecting above the primary sealing membrane of the bottom wall of the tank, the flared upper portion being equipped with a through-orifice and with a nonreturn valve associated with the orifice and having a direction of opening oriented in the direction of the inside of the container.

21. The tank as claimed in claim 1, in which the bottom wall of the or each container is parallel to the internal bottom wall of the double hull.

22. A ship for transporting a cold liquid product, the ship comprising a double hull and a tank arranged in the double hull, the tank being sealed, insulated and equipped with an unloading pump, the tank comprising tank walls which are fixed to internal walls of the double hull, in which a tank wall comprises a multilayer structure with multiple layers superposed in a thickness direction including a primary sealing membrane intended to be in contact with a product contained in the tank, a secondary sealing membrane arranged between the primary sealing membrane and the internal wall of the double hull, a secondary thermal insulation barrier arranged between the secondary sealing membrane and the internal wall of the double hull and supporting the secondary sealing membrane, and a primary thermal insulation barrier arranged between the primary sealing membrane and the secondary sealing membrane and supporting the primary sealing membrane, in which an internal bottom wall of the double hull bears a bottom wall of the tank and a sump structure locally interrupting the primary sealing membrane of the bottom wall of the tank, the sump structure comprising a rigid container arranged through the thickness of the bottom wall of the tank, the unloading pump being arranged in the tank so that it draws up the product contained in the tank toward the top of the tank, the unloading pump comprising a suction member housed in said rigid container, in which the rigid container comprises a bottom wall situated at a more exterior level than the secondary sealing membrane of the bottom wall of the tank in the thickness direction of the bottom wall of the tank and a peripheral lateral wall connected in a sealed manner to the bottom wall of the container so as to be closed by the bottom wall of the container, the peripheral lateral wall extending toward the inside of the tank from the bottom wall of the container at least as far as the primary sealing membrane of the bottom wall of the tank, the peripheral lateral wall having an opening situated opposite the bottom wall of the container and opening to the inside of the tank, in which the sump structure comprises a primary connecting plate surrounding the container and having an internal edge connected in a sealed manner, directly or indirectly, to the peripheral lateral wall of the container all around the container, the primary connecting plate having a connecting surface extending parallel to the primary sealing membrane of the bottom wall of the tank, the primary sealing membrane of the bottom wall of the tank being attached in a sealed manner to the connecting surface all around the sump structure.

23. A transfer system for transferring a cold liquid product, the system comprising a ship as claimed in claim 22, insulated pipes arranged in such a way as to connect the tank installed in the hull of the ship to a floating or on-shore storage facility, said unloading pump being able to drive a stream of cold liquid product through the insulated pipes toward the floating or on-shore storage facility from the tank of the ship.

* * * * *